US009815304B2

(12) United States Patent
Tsuchida

(10) Patent No.: US 9,815,304 B2
(45) Date of Patent: Nov. 14, 2017

(54) LABEL PRINTER

(71) Applicant: TOSHIBA TEC KABUSHIKI KAISHA, Shinagawa-ku, Tokyo (JP)

(72) Inventor: Kengo Tsuchida, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/058,227

(22) Filed: Mar. 2, 2016

(65) Prior Publication Data

US 2016/0176205 A1 Jun. 23, 2016

Related U.S. Application Data

(62) Division of application No. 14/837,188, filed on Aug. 27, 2015.

(30) Foreign Application Priority Data

Aug. 28, 2014 (JP) ..... 2014-174532

(51) Int. Cl.
*B41J 3/407* (2006.01)
*B41J 11/70* (2006.01)

(52) U.S. Cl.
CPC ..... *B41J 11/70* (2013.01); *B41J 3/4075* (2013.01); *B41J 11/703* (2013.01)

(58) Field of Classification Search
CPC ... B41J 3/4075; B41J 3/39; B41J 11/66; B41J 11/663; B41J 11/703; B65C 11/02
See application file for complete search history.

(56) References Cited

U.S. PATENT DOCUMENTS 3,867,861 A * 2/1975 Hamisch, Sr. ..... B26D 5/14 234/117
3,965,772 A * 6/1976 Hamisch, Sr. ..... B26D 5/14 74/522

(Continued)

FOREIGN PATENT DOCUMENTS

JP 2010-089215 4/2010
JP 2010-168174 8/2010

(Continued)

OTHER PUBLICATIONS

Final Office Action for U.S. Appl. No. 14/837,188 mailed on Jun. 17, 2016.

(Continued)

*Primary Examiner* — Sharon A Polk
(74) *Attorney, Agent, or Firm* — Amin, Turocy & Watson, LLP

(57) ABSTRACT

A label printer includes a storage section which stores label papers where an adhesive layer is arranged opposite to a printing surface; a printing section; a cutting section which cuts the printed label papers sequentially from one end to an other end of a printed label paper in a width direction of the papers by vertically moving a movable blade towards a fixed blade; a stage which is arranged at the downstream side in the paper conveyance direction of the cutting section and receives a cut label; and a projection section which is arranged in an area of the stage corresponding to a part where the movable blade of the cutting section positioned at a lowest point is positioned lower than the stage, and projects from a top surface of the stage, where the area is one third of a width of the label paper.

3 Claims, 6 Drawing Sheets

(56) References Cited

U.S. PATENT DOCUMENTS

| | | | | |
|---|---|---|---|---|
| 5,248,139 | A | 9/1993 | Garland | |
| 8,834,048 | B2 | 9/2014 | Mochida et al. | |
| 2005/0158095 | A1 | 7/2005 | Nagayama | |
| 2006/0008312 | A1 | 1/2006 | Sago | |
| 2010/0086340 | A1* | 4/2010 | Takami | B26D 7/088 400/621 |
| 2010/0187744 | A1 | 7/2010 | Hirabayashi | |
| 2010/0221057 | A1 | 9/2010 | Shirotori et al. | |

FOREIGN PATENT DOCUMENTS

| | | | |
|---|---|---|---|
| JP | 5557111 | 7/2014 | |
| JP | 5557111 B2 * | 7/2014 | B41J 15/04 |

OTHER PUBLICATIONS

Non-Final Office Action for U.S. Appl. No. 14/837,188 mailed on Dec. 4, 2015.

Japanese Office Action for Japanese Patent Application No. 2014-174532 dated May 9, 2017.

* cited by examiner

LABEL PRINTER

CROSS-REFERENCE TO RELATED APPLICATIONS

This application is a Division of application Ser. No. 14/837,188 filed on Aug. 27, 2015, the entire contents of which are incorporated herein by reference.

This application is based upon and claims the benefit of priority from Japanese Patent Application No. 2014-174532, filed Aug. 28, 2014, the entire contents of which are incorporated herein by reference.

FIELD

Embodiments described herein relate generally to a label printer.

BACKGROUND

In general, a label paper wound into a roll shape has a constitution in which labels having adhesive layers are attached to a mount at given intervals with a space between the adjacent labels. Then, a cutting section of a label printer cuts spaces between labels. Thus, in a case of a label with mount, because the adhesive layer of label isn't cut, the glue will not adhere to a blade of the cutting section.

On the other hand, a long-sized label paper without mount has appeared in recent years. In a case of such a label paper without mount, the cutting section of the label printer cuts the adhesive layer after the printing operation, and thus the glue adheres to the movable blade of the cutting section.

However, if the adhesive layer of the label paper without mount is at the side of the movable blade, since the label subjected to cut processing moves while being attached to the movable blade which returns to a home position, there is a problem that the label bends between the movable blade and a member which receives the label after printing and cutting operation.

DETAILED DESCRIPTION

In accordance with an embodiment, a label printer includes a storage section configured to store roll-shaped label papers in which an adhesive layer is arranged on a side opposite to a printing surface serving as a printing object of the label papers; a printing section configured to carry out printing processing on the label papers that are conveyed from the storage section; a cutting section configured to be arranged at a downstream side in a paper conveyance direction of the printing section to cut the printed label papers sequentially from one end to an other end of each of the printed label papers in a width direction of the label paper by moving in a vertical direction a movable blade towards a fixed blade; a stage configured to be arranged at the downstream side in the paper conveyance direction of the cutting section to receive a label cut by the cutting section; and a projection section configured to be arranged in an area of the stage corresponding to a part where the movable blade of the cutting section positioned at a lowest point is positioned lower than the stage, and project from a top surface of the stage, where the area is one third of a width of the label paper.

Hereinafter, a label printer according to an embodiment is described with reference to the accompanying drawings. The embodiment described below is an example applicable to a label printer which issues labels on which information relating to a commodity such as food is printed. However, the present invention is not limited to this, and no limitation is given to an apparatus as long as it can print various kinds of information in an image receiving medium such as a label paper and the like.

Figure 1:
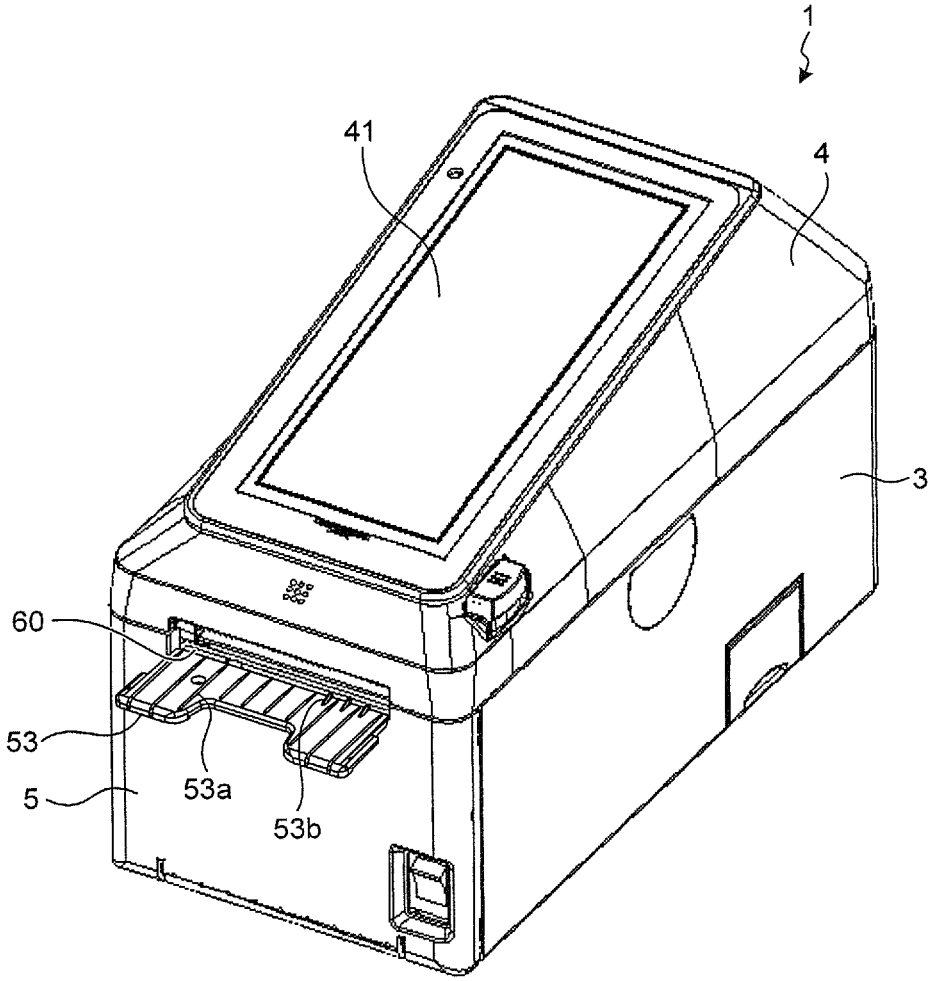
FIG. 1 is an external perspective view illustrating a label printer according to an embodiment.
Figure 2:
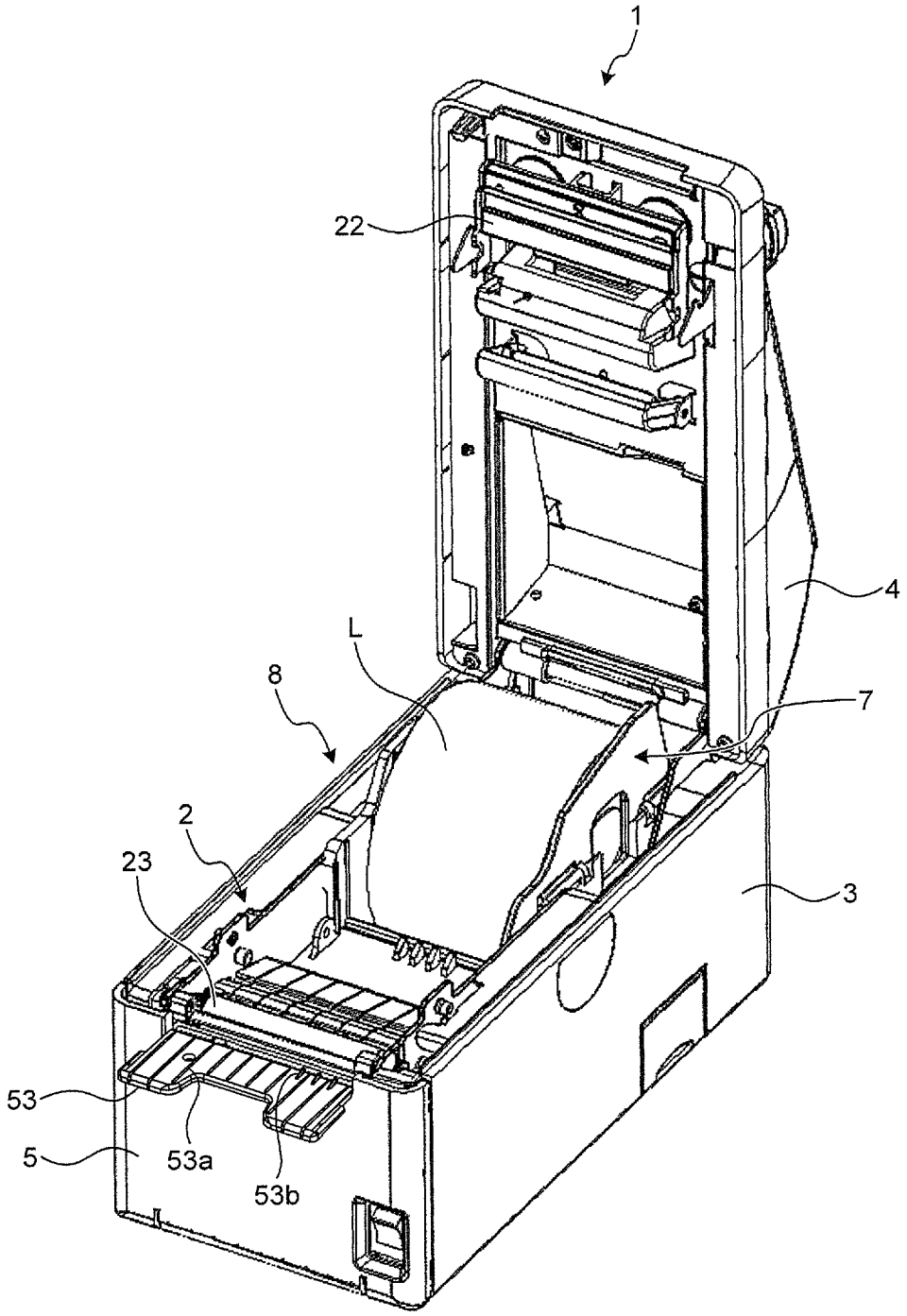
FIG. 2 is a perspective view illustrating a state in which an upper case of the label printer is opened.
Figure 3:
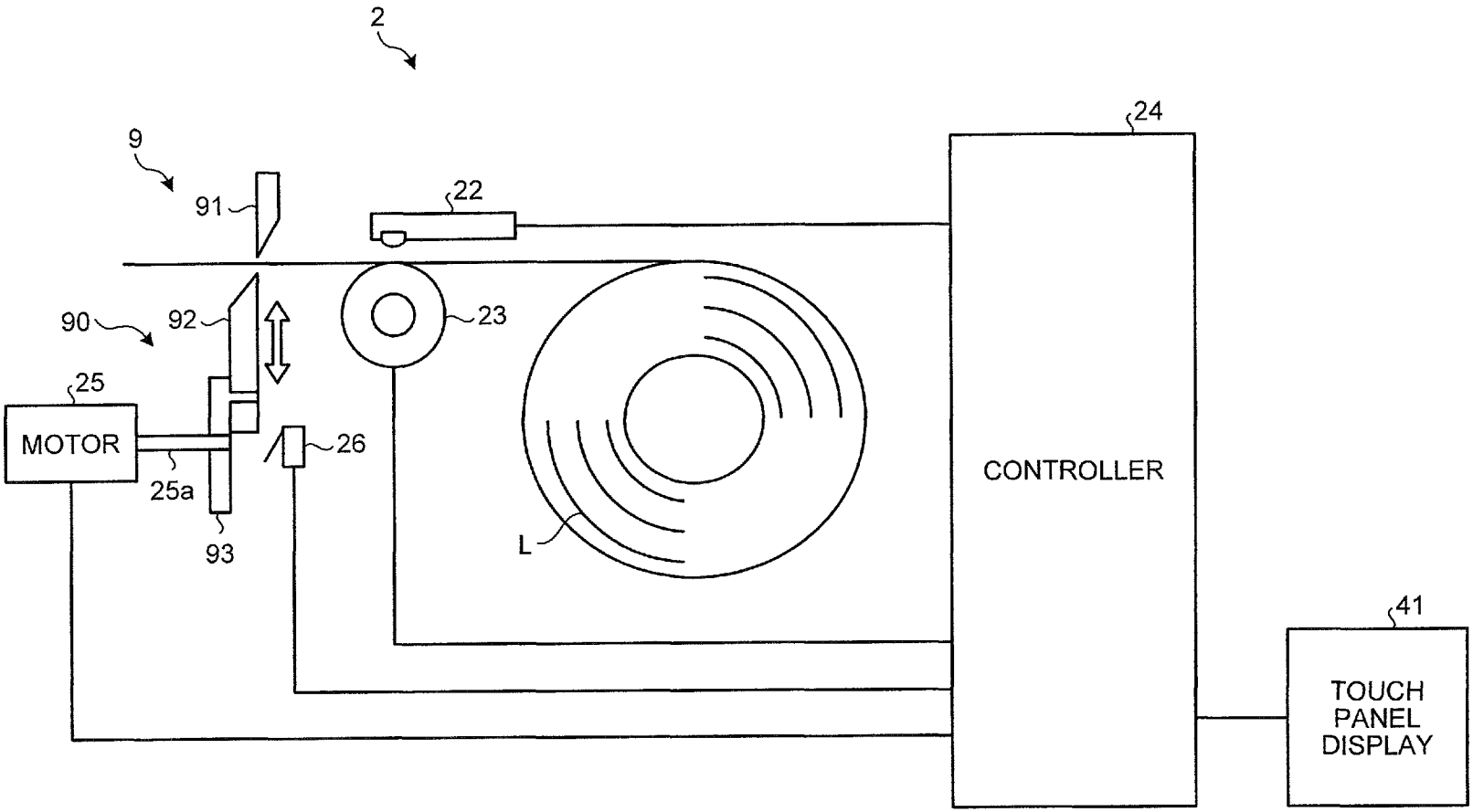
FIG. 3 is a longitudinal sectional side view illustrating a schematic constitution of the printer main body and a conveyance state of label paper.

FIG. 1 is an external perspective view illustrating a label printer 1 according to the embodiment. FIG. 2 is a perspective view illustrating a state in which an upper case 4 of the label printer 1 is opened. FIG. 3 is a longitudinal sectional view illustrating the schematic constitution of a printer main body 2 housed in the label printer 1 and a conveyance state of a label paper L.

The printer main body 2 is arranged inside the label printer 1. In addition, the printer main body 2 is covered by a lower case 3, an upper case 4 and a front cover 5 to be protected from impact, dust and the like from the outside.

In addition to the printer main body 2 mentioned above, the label printer 1 is further provided with a storage section 8, which houses not only the label paper L wound into a roll shape but also a holder 7 serving as a holding member holding the label paper L, inside thereof.

The label paper L is a long-sized label paper without mount. In such a label paper L, an adhesive layer is arranged on the back side of the printing surface thereof.

The lower case 3 is a rectangular parallelepiped case of which the top surface and the front surface are opened, the top surface is closed by the upper case 4 and the front surface is closed by the front cover 5. In addition, a connection terminal (not shown) used for the connection of the internal printer main body 2 with an external machine and a power supply terminal (not shown) used for supplying power to the printer main body 2 and the like are arranged in the lower case 3.

The upper case 4 is also used as an opening and closing member of the lower case 3. The upper case 4 is provided with a touch panel display 41. The touch panel display 41 not only receives the input of various kinds of operations but also displays various kinds of information.

As stated above, the storage section 8 stores the label paper L and the holder 7. Further, in a case of using a label paper L that is not required to be held by the holder 7, the storage section 8 stores the label paper L directly.

The front cover 5 is provided with a member (hereinafter referred to as a stage) 53 where labels X (refer to FIG. 7) that are printed and cut are received. The front cover 5 covers the front surface of the printer main body 2 in an openable manner, and is opened or closed to the outside. Further, a label discharge port 60 for discharging the labels X is arranged between the upper end of the front cover 5 and the lower portion on the front end of the upper case 4.

In the present embodiment, a label presser 61 (refer to FIG. 7) pressing the labels X subjected to cutting processing that are received on the stage 53 is arranged at one side opposite to the side where a later-described projection section 53*b* in the lower portion on the front end (label discharge port 60) of the upper case 4 is arranged. The label presser 61 may be a charge removing brush, a "dog-legged" member made from PET (polyethylene terephthalate) serving as one kind of synthetic resins (plastic), an elastic member such as rubber, and the like.

The printer main body 2 comprises a print head 22 and a platen roller 23. A printing section consists of the print head 22 and the platen roller 23. The print head 22 consisting of a thermal head (not shown) having heating elements (not shown), a controller 24 and the like, prints information on the printing surface of the label paper L. The platen roller 23 conveys the label paper L and presses the label paper L against the print head 22 with a motor 25 and a driving gear (not shown).

As shown in FIG. 3, the printer main body 2 is provided with a so-called guillotine type cutting section 9 which is arranged at the downstream side in the paper conveyance direction of the platen roller 23 in the nearer side of the front cover 5 and comprises a fixed blade 91 and a movable blade 92 facing to each other across a paper conveyance path. The movable blade 92 of the cutting section 9 is inclined from one end (upper side) towards the other end (lower side). Though the detail is described later, the cutting section 9 moves the movable blade 92 towards the fixed blade 91, and enables the movable blade 92 to mesh with the fixed blade 91 along the width direction of the fixed blade 91 in sequence. In this way, the cutting section 9 sequentially cuts the label paper L nipped between the fixed blade 91 and the movable blade 92 from one end to the other end.

The controller 24 connects with the touch panel display 41, the platen roller 23, the printing head 22, the motor 25 and a home position sensor 26. In this way, the controller 24 controls various processing including a conveyance processing, a printing processing, and a cutting processing of the label paper L. The controller 24 also controls various screens displayed on the touch panel display 41.

That is, the platen roller 23 is driven to rotate by the motor 25 that is driven under the control of the controller 24 to draw out the free end side of the label paper L wound into a roll shape and convey it to a direction of the label discharge port 60 (paper conveyance direction).

The print head 22 nips the label paper L with the platen roller 23, and prints information on the printing surface of the label paper L in conveyance under the control of the controller 24. Then, the label paper L is conveyed to a cutting place of label paper L by the cutting section 9 through the rotary driving of the platen roller 23 according to the control of the controller 24. Then, the label paper L is cut by the cutting section 9 that is driven according to the control of the controller 24 at the cutting place. Further, the label paper L conveyed to the cutting place of the cutting section 9 is to be guided to the stage 53 arranged in the front cover 5. Then, the stage 53 receives the labels X (refer to FIG. 7) after being printed and cut after the printing and cutting operations.

Figure 4:
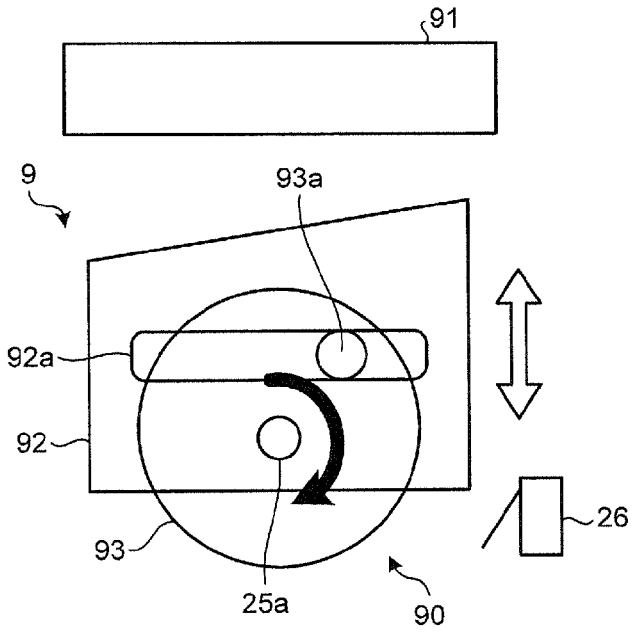
FIG. 4 is a front view schematically illustrating a cutting mechanism of a cutting section.

Herein, a cutting mechanism of the cutting section 9 is described. FIG. 4 is a front view schematically illustrating a cutting mechanism of the cutting section 9. In FIG. 4, the cutting section 9 is observed from the side of the printing section. As shown in FIG. 4, a driving section 90 driving the cutting section 9 comprises the motor 25 mentioned above, a disc 93 and a pin 93*a* provided in the disc 93. Then, the driving section 90 is monitored according to signals output from the installed home position sensor 26.

The disc 93 constitutes an eccentric mechanism having the pin 93*a* at a position separated from a center point where a shaft 25*a* of the motor 25 is installed. That is, the disc 93 can change the rotary motion to a reciprocation of the pin 93*a*. In addition, the pin 93*a* is inserted into a groove 92*a* provided in the movable blade 92.

The shape of the groove 92*a* provided in the movable blade 92 is rectangular. The size of the groove 92*a* in a vertical direction the movable blade 92 moves is almost identical to the diameter of the pin 93*a*. On the other hand, the size of the groove 92*a* in a horizontal direction perpendicular to the vertical direction is almost identical to the diameter of the circular orbit of the pin 93*a*.

Thus, even if the pin 93*a* in the disc 93 moves along the circular orbit through the rotation of the motor 25, the movable blade 92 moves in the vertical direction but not in the horizontal direction. That is, the movable blade 92 is thrust upward from the home position towards the fixed blade 91 through the rotary driving of the motor 25 that is driven according to the control of the controller 24 so as to mesh with the fixed blade 91 sequentially from the higher side of the blade edge of the movable blade 92 that interferes with the fixed blade 91 first. Consequently, the label paper L between the movable blade 92 and the fixed blade 91 is sequentially cut from one end towards the other end. For example, the home position refers to a lowest point when the movable blade 92 moves in the vertical direction.

The home position sensor 26 detects whether or not the movable blade 92 is located at the home position. The home position sensor 26 outputs a signal indicating an ON state when the movable blade 92 is located at the home position (lowest point), and outputs a signal indicating an OFF state when the movable blade 92 isn't located at the home position (lowest point). That is, the home position sensor 26 detects that the movable blade 92 returns to the home position after cutting the label paper L. In this way, the start and completion of cutting operation on the label paper L can be detected according to the signals received from the home position sensor 26 by the controller 24.

Next, the stage 53 is described. As stated above, the front cover 5 is provided with the stage 53 which receives the labels X (refer to FIG. 7) that are printed and cut. Herein, FIG. 5 is a perspective view illustrating the stage 53, and FIG. 6 is a section view illustrating the stage 53.

Figure 5:
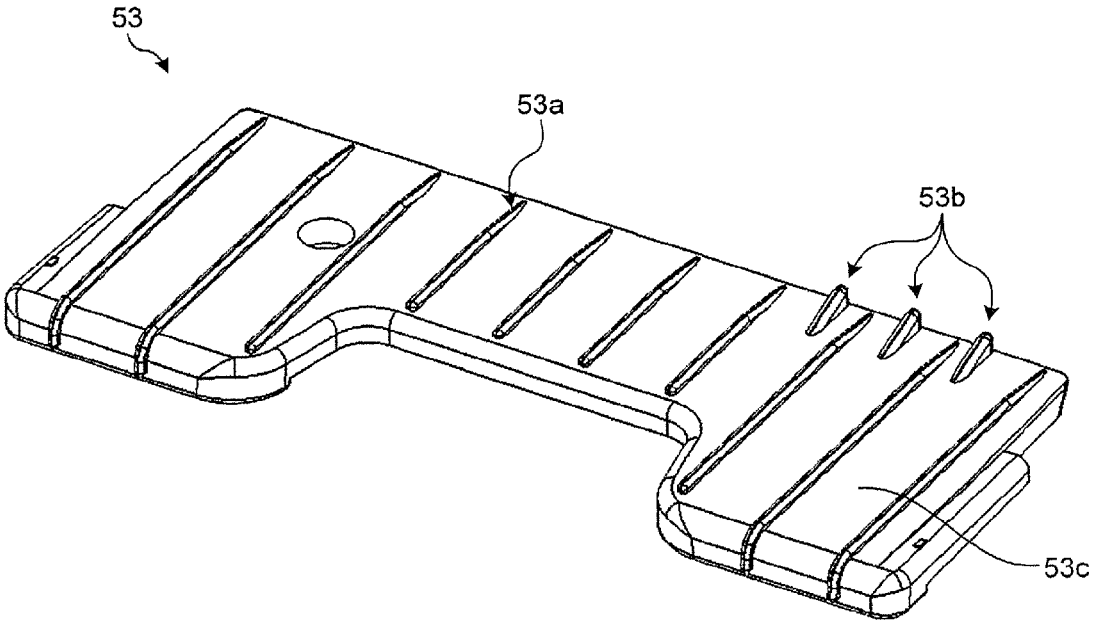
FIG. 5 is a perspective view illustrating a stage.
Figure 6:
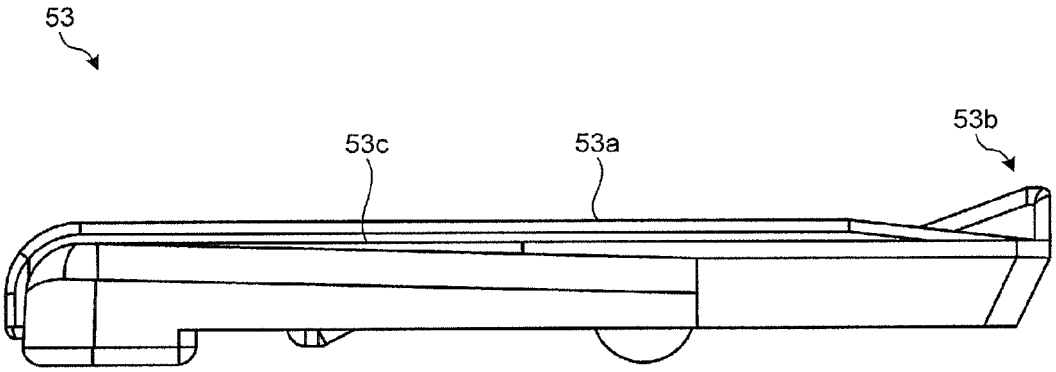
FIG. 6 is a side view illustrating the stage.

As shown in FIG. 5 and FIG. 6, the stage 53 includes a plurality of elongated convex portions 53*a* which are almost parallel to each other on a top surface 53*c*. That is, the convex portion 53*a* is in a rib shape. The rib-shaped convex portions 53*a* are arranged on the top surface 53*c* of the stage 53 as described above in order to prevent the bonding of the adhesive layer on the back side of the label X printed and cut. With such a constitution, the printed and cut labels X can be prevented from a discharge paper jam due to the bonding of the adhesive layer to the stage 53.

In addition, as shown in FIG. 5 and FIG. 6, projection sections 53*b* protruding from the top surface 53*c* separated from the convex portions 53*a* are arranged between parts of the convex portions 53*a* on the top surface 53*c* of the stage 53. The projection sections 53*b* are arranged to be shifted to an area having a size of about one third of the width of the label paper L (the label X that is printed and cut). For example, in a case in which the width of the label paper L (the label X that is printed and cut) is 60 mm, the projection sections 53*b* are arranged extending an area having a size of about 20 mm.

The projection section 53*b* has a length of about 6 mm, and a height of about 2 mm. Further, the height at the highest point of the projection section 53*b* is higher than that of the convex section 53*a*. In addition, the reason why the projection section 53*b* has a height of about 2 mm is that the printed and cut label X may be caught on the projection section 53*b* when the printed and cut label X is curled intensely if the height of the projection section 53*b* is increased.

Next, the relation between the projection sections 53*b* of the stage 53 and the movable blade 92 of the cutting section 9 is described. Herein, FIG. 7 is an enlarged front view illustrating the label discharge port 60 of the label printer 1, and FIG. 8 is a perspective view illustrating the position relation between the stage 53 and the cutting section 9.

Figure 7:
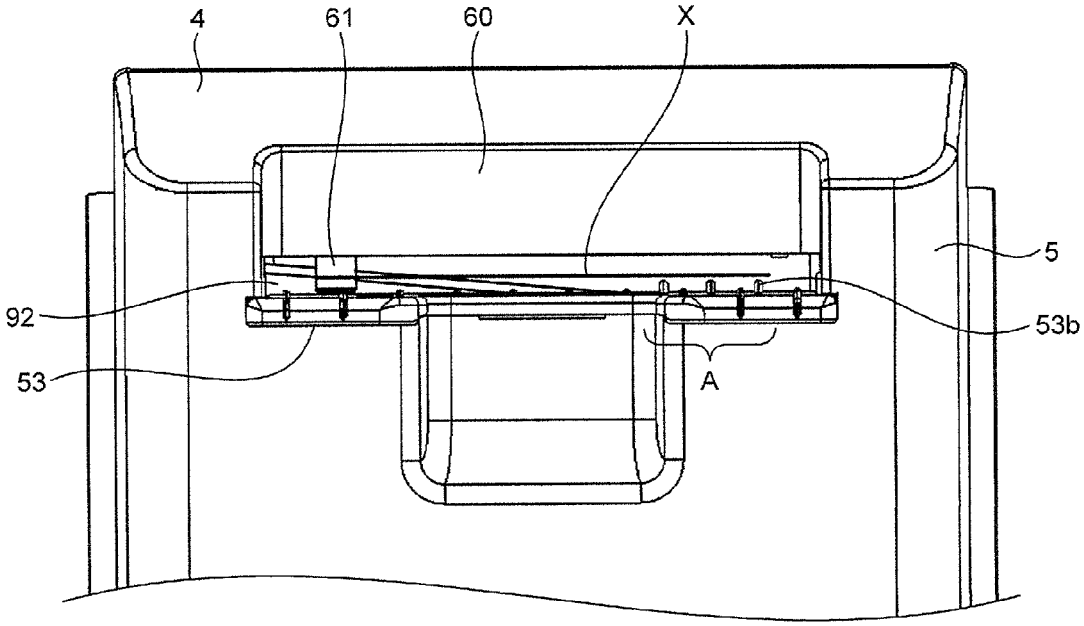
FIG. 7 is an enlarged front view illustrating a label discharge port of the label printer.
Figure 8:
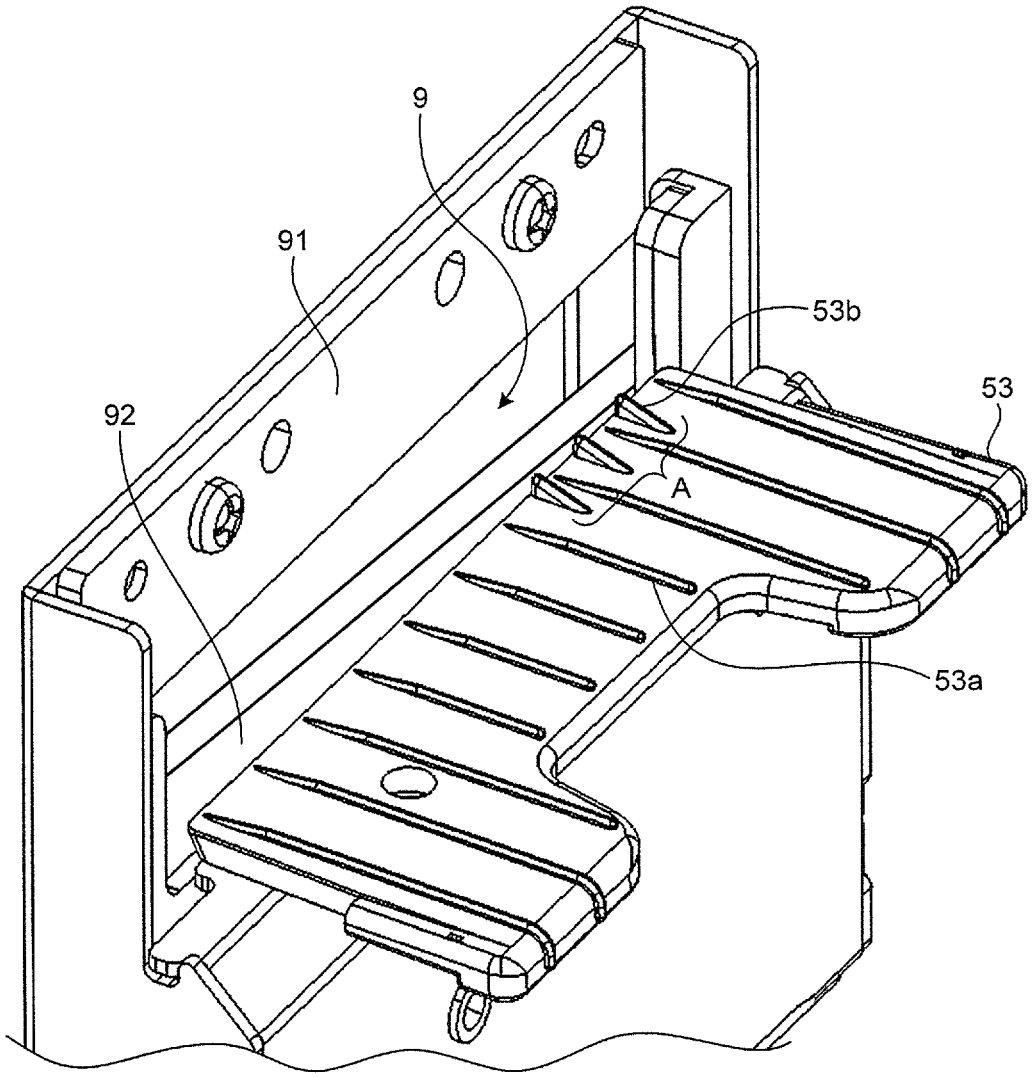
FIG. 8 is a perspective view illustrating a position relation between the stage and the cutting section.

As shown in FIG. 7 and FIG. 8, the projection sections 53*b* on the stage 53 are arranged at the lower side of the inclination of the movable blade 92 of the cutting section 9. The projection sections 53*b* on the stage 53 are arranged at positions higher than the lower side of the inclination of the movable blade 92 of the cutting section 9 that is positioned at the home position as shown in FIG. 7. That is, the projection sections 53*b* are arranged in an area of the stage 53 corresponding to the part where the movable blade 92 of the cutting section 9 is positioned lower than the stage 53.

The reason why the position relation between the projection sections 53*b* on the stage 53 and the movable blade 92 of the cutting section 9 is set as described above is as follows.

Conventionally, when the adhesive layer of the label paper L (the label X that is printed and cut) is at the side of the movable blade 92, the cut label X adheres to the blade edge of the movable blade 92. Then, the adhered label X moves together with the movable blade 92 which moves in a direction away from the fixed blade 91 to return to the home position. The cut label X reaches the stage 53 from an end where the blade edge is lower than that of the other end of the movable blade 92. Then, after the end where the blade edge is lower reaches the stage 53, the movable blade 92 further moves together with the cut label X to a position lower than the stage 53.

As a result, a gap is generated between the stage 53 and the movable blade 92 in the part where the blade edge of the movable blade 92 is lower than the stage 53, and thus there is a problem that a crease occurs in the label X.

Thus, in the present embodiment, the projection sections 53*b* are arranged in an area A on the stage 53 corresponding to the part where the movable blade 92 of the cutting section 9 is lower than the stage 53. In this way, the cut label X can be peeled by the label printer 1 from the movable blade 92 from an early stage through the projection sections 53*b* with a returning force of the movable blade 92 to the home position. As stated above, the area A on the stage 53 is an area having a size of about one third of the width of the label paper L (the label X that is printed and cut). For example, when the width of the label paper L (the label X that is printed and cut) is 60 mm, the projection sections 53*b* are arranged extending an area having a size of about 20 mm.

Furthermore, it is exemplified in the present embodiment that a label presser 61 which presses the cut labels X received on the stage 53 is arranged in the lower portion on the front end (label discharge port 60) of the upper case 4. In this way, it is easy to peel the cut label X from the movable blade 92 through the projection section 53*b*.

As stated above, in accordance with the present embodiment, since it is possible to keep the cut labels X always at a same position, and the load at the time of peeling the cut labels X is reduced, the worker can operate smoothly. Further, in accordance with the present embodiment, as the situation on the creases generated in the cut labels X can also be improved, it is possible to keep the cut labels X in a clean state.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A label printer, comprising:

a storage section configured to store a roll-shaped label paper in which an adhesive layer is arranged on a side opposite to a printing surface serving as a printing object of the label paper;

a printing section configured to carry out printing processing on the label paper that is conveyed from the storage section;

a cutting section configured to be arranged at a downstream side in a paper conveyance direction of the printing section and comprising a fixed blade that is positioned upper than the conveyed label paper and a moveable blade that is arranged opposite to the fixed blade and that is inclined from an upper side towards a lower side and from a first end towards a second end in a width direction of the movable blade to cut the printed label paper from a side of the first end to a side of the second end of the printed label paper by moving the movable blade upwardly from a home position towards the fixed blade, wherein, after the printed label paper is cut, the cutting section moves the movable blade downwardly from a side of the fixed blade and returns the movable blade to the home position;

a stage configured to be arranged at the downstream side in the paper conveyance direction of the cutting section to receive the printed label paper that is cut by the cutting section;

a plurality of convex sections configured to be arranged on a surface that is a top surface of the stage and that is a surface receiving the printed label paper, and arranged along the paper conveyance direction; and a projection section configured to be arranged in a part that is an end of the top surface of the stage along a side of the movable blade and that corresponds to the side of the second end, the part being a part where the movable blade positioned at the home position is positioned lower than the top surface of the stage, wherein the projection section has a height that is higher than a convex section, and a surface of the projection section on the side of the movable blade is arranged along a moving direction of the movable blade.

2. The label printer according to claim 1, wherein there is a plurality of projection sections, and the projection sections are respectively arranged between the convex sections.

3. The label printer according to claim 1, further comprising:

a label presser configured to be arranged at a position opposite to the top surface of the stage and in a part corresponding to the first end.

* * * * *